US005564905A

United States Patent [19]

Manring

[11] Patent Number: 5,564,905

[45] Date of Patent: Oct. 15, 1996

[54] DISPLACEMENT CONTROL FOR A VARIABLE DISPLACEMENT AXIAL PISTON PUMP

[75] Inventor: Noah D. Manring, Roland, Iowa

[73] Assignee: Caterpillar Inc., Peoria, Ill.

[21] Appl. No.: 324,564

[22] Filed: Oct. 18, 1994

[51] Int. Cl.[6] ..... F04B 1/32

[52] U.S. Cl. ..... 417/222.1; 417/506; 91/482; 91/505

[58] Field of Search ..... 417/222.1, 222.2, 417/269, 506; 91/482, 486, 505

[56] References Cited

U.S. PATENT DOCUMENTS

| | | | |
|---|---|---|---|
| 3,117,529 | 1/1964 | Firth et al. | 91/482 |
| 3,185,104 | 5/1965 | Liles | 91/482 |
| 3,190,232 | 6/1965 | Budzich | 91/482 |
| 3,327,642 | 6/1967 | Budzich | 91/482 |
| 3,362,342 | 1/1968 | Flint et al. | 91/482 |
| 4,617,853 | 10/1986 | Wagenseil et al. | 91/505 |
| 4,800,800 | 1/1989 | Schweitzer | 91/505 |
| 4,918,918 | 4/1990 | Miki et al. | 60/489 |
| 5,135,362 | 8/1992 | Martin | 417/222 |

FOREIGN PATENT DOCUMENTS

| | | |
|---|---|---|
| 62-169269 | 10/1987 | Japan . |
| 1-267386 | 10/1989 | Japan . |

*Primary Examiner*—Timothy S. Thorpe
*Assistant Examiner*—William Wicker
*Attorney, Agent, or Firm*—John W. Grant

[57] ABSTRACT

A variable displacement axial piston hydraulic unit includes a flat port plate disposed between a stationery head and a rotatable cylinder barrel. An arcuate actuator piston extends from the port plate and is slidably disposed within an arcuate pocket in the head to define an actuator chamber. Similarly, an arcuate biasing piston extends from the port plate and is slidably disposed within an arcuate pocket defining a biasing chamber which continuously communicates with a discharge passage in the head. By selectably rotating the port plate relative to the head, the amount of fluid pressure carryover through TDC and BDC can be varied, thereby changing the swivel torque acting on the swashplate so that the swivel torque can be utilized to actually control the position of the swashplate. The rotational position of the port plate is controlled by controllably introducing pressurized fluid into the actuating chamber.

5 Claims, 3 Drawing Sheets

DISPLACEMENT CONTROL FOR A VARIABLE DISPLACEMENT AXIAL PISTON PUMP

TECHNICAL FIELD

This invention relates generally to a variable displacement axial piston unit and, more particularly, to a displacement controller utilizing the naturally existing swivel torque within the unit for adjusting the swashplate angle.

BACKGROUND ART

Variable displacement axial piston pumps and motors generally include a rotatable cylinder barrel containing several pistons which reciprocate in mating piston bores, more or less, parallel to the axis of a drive shaft. One end of each piston is held against a tiltable swashplate. When the swashplate is tilted relative to the drive shaft axis, the pistons reciprocate within their bores and a pumping action occurs. Each piston bore is subjected to two main pressure levels during each revolution of the cylinder barrel. One pressure is a result of the load and is located on one side of the ramp of the tilted swashplate. The other pressure is normally much lower and is located on the other side of the swashplate ramp. As the piston bores sweep past the top and bottom dead center positions, a swivel torque is generated on the swashplate as a result of the reciprocating pistons and pressure carryover within the piston bores.

The swashplate is typically controlled using one or more actuators and a bias spring to offset the swivel torque. The swivel torque is quite high in today's high pressure axial piston units such that the actuators are quite large and may account for approximately 20% of the overall size of the pump or motor. Swashplate response and control response are limited because of the volumes of fluid that need to flow into and out of the hydraulic actuators and the total added inertia of the actuators. Moreover, such actuator system within the pump contributes from about 7–12% of the overall cost of the pump. These costs result from the number of pieces used in the actuators and the precision machining of several large pieces and the expense associated with assembly of the pump.

There have been at least two proposals to control the angle of the swashplate by using the pistons within the cylinder barrel instead of a separate actuation system. One such unit is disclosed in Japanese Utility Model Application No. 61-37882. Another unit is disclosed in U.S. Pat. No. 4,918,918. Both of those disclosures have control ports at the top and bottom dead center positions for communicating with the piston bores as they sweep past the dead center positions. The control ports are selectably communicated to the intake and discharge ports to control the pressure therein to modify the swivel torque imposed on the swashplate to control swashplate positioning.

DISCLOSURE OF THE INVENTION

In one aspect of the present invention, a displacement control for a variable displacement axial piston hydraulic unit comprises a head having an intake passage and a discharge passage therein; a flat port plate coupled to the head for limited rotational movement relative thereto and having an arcuate intake port and an arcuate discharge port extending therethrough and continuously communicating with the intake and discharge passages respectively; a rotatable cylinder barrel disposed in sliding contact with the port plate and having a plurality of equally spaced, circumferentially arranged piston bores therein disposed to sequentially open into the intake and discharge passages in a timed relationship as the cylinder barrel rotates; and means for selectably rotating the port plate so that the timed opening of the piston bores into the intake and discharge ports is controllably changed.

BEST MODE FOR CARRYING OUT THE INVENTION

Figure 1:
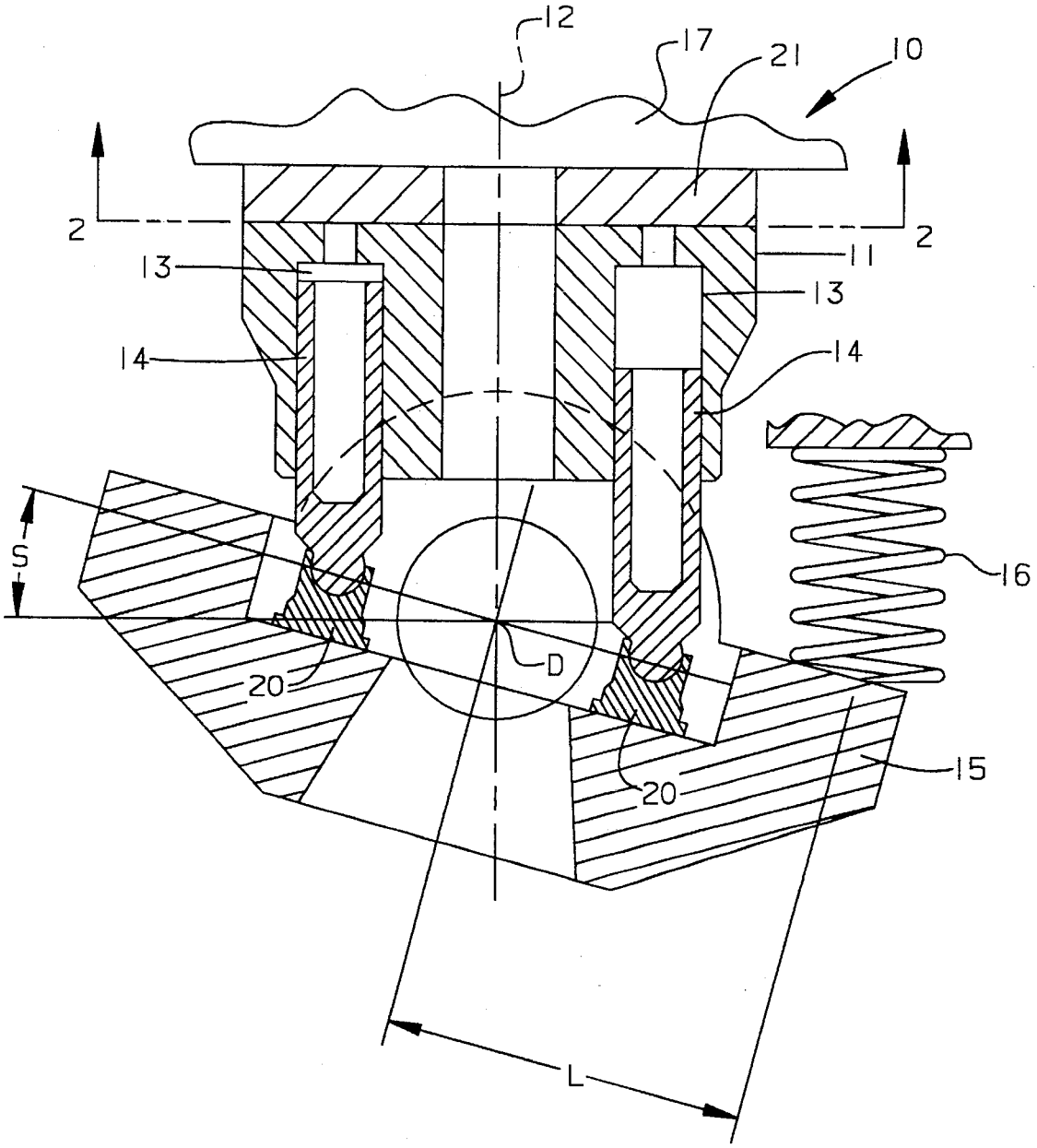
FIG. 1 is a diagrammatic side elevational view of a variable displacement axial piston hydraulic unit illustrating an embodiment of the present invention.

A variable displacement axial piston hydraulic unit is generally indicated by the reference numeral 10. The hydraulic unit 10 can be either a pump or a motor but, in this embodiment, is described as a hydraulic pump having a cylinder barrel 11 rotatable about an axis 12. The cylinder barrel has a plurality of equally spaced, circumferentially arranged piston bores 13 provided therein. Each of a plurality of pistons 14 are reciprocatably disposed in the respective piston bores 13. A swashplate 15 is conventionally mounted adjacent one end of the cylinder barrel for tilting movement about an axis D to adjust the stroke of the pistons. The swashplate is continuously biased toward the maximum displacement position by a spring 16. A stationary head 17 is disposed at the other end of the cylinder barrel and has an intake passage 18 and a discharge passage 19 disposed therein. A ball and socket joint connects the base of each piston to a slipper 20 maintained in sliding contact with the swashplate in the usual manner. The centers of the ball and socket joints are coincident with the axis 16.

A flat timing port plate 21 is disposed between the cylinder barrel and the head and is coupled to the head for limited rotational movement relative thereto. The port plate 21 has an arcuate intake port 22 and an arcuate discharge port 23 extending therethrough for continuous communication with the intake and discharge passages 18,19 in the head 17. A pair of metering slots 24,25 open into the intake and discharge ports 22,23 respectively at the leading edges thereof. The cylinder barrel is disposed in sliding contact with the port plate so that the piston bores sequentially open into the intake and discharge ports in a timed relationship as the cylinder barrel rotates.

A means 27 is provided for selectively rotating the port plate 21 relative to the head 17 so that the timed opening of the piston bores into the intake and discharge ports can be controllably changed. The means 27 includes a means 28 for exerting a biasing force against the port plate 21 in a clockwise direction and a hydraulic actuator 29 for selectively applying a variable control force against the port plate in opposition to the biasing force. The hydraulic actuator 29 includes an arcuate pocket 31 in the head 17 and an arcuate piston 32 extending from the port plate 21 and slidably disposed within the arcuate pocket. The piston 32 has an end 33 defining an actuating chamber 34 at one end of the arcuate pocket. A passage 35 in the head communicates the actuating chamber 34 with the exterior surface (not shown) for controllably introducing pressurized control fluid. The biasing means 28 includes an arcuate pocket 36 in the head 17 and an arcuate piston 37 extending from the port plate and slidably disposed within the arcuate pocket 36. The arcuate piston 37 has an end 38 defining a biasing chamber 39 connected to the discharge passage 19 through a passage 41. A pair of chambers 42,43 formed at the other ends of the arcuate pistons 32,37 respectively are continuously communicated with a case drain (not shown) of the hydraulic unit. The area of the end 33 of the piston 32 is greater than the end 38 of the piston 37. The arcuate pockets 31,36 and the arcuate pistons 32,37 are concentric with the axis 12.

The arcuate pockets 31,36 and the arcuate pistons 32,37 serve to couple the port plate 21 to the head 17 for limited rotation of the port plate about the axis 12. A pair of transition regions 44,46 are disposed between the intake and discharge ports 22,23 at the top dead center and bottom dead center positions TDC and BDC of the hydraulic unit. TDC and BDC are on a line 47 as shown on FIG. 2. Each of the piston bores becomes isolated from both the intake and discharge ports as they sweep through the transition regions.

INDUSTRIAL APPLICABILITY

Figure 2:
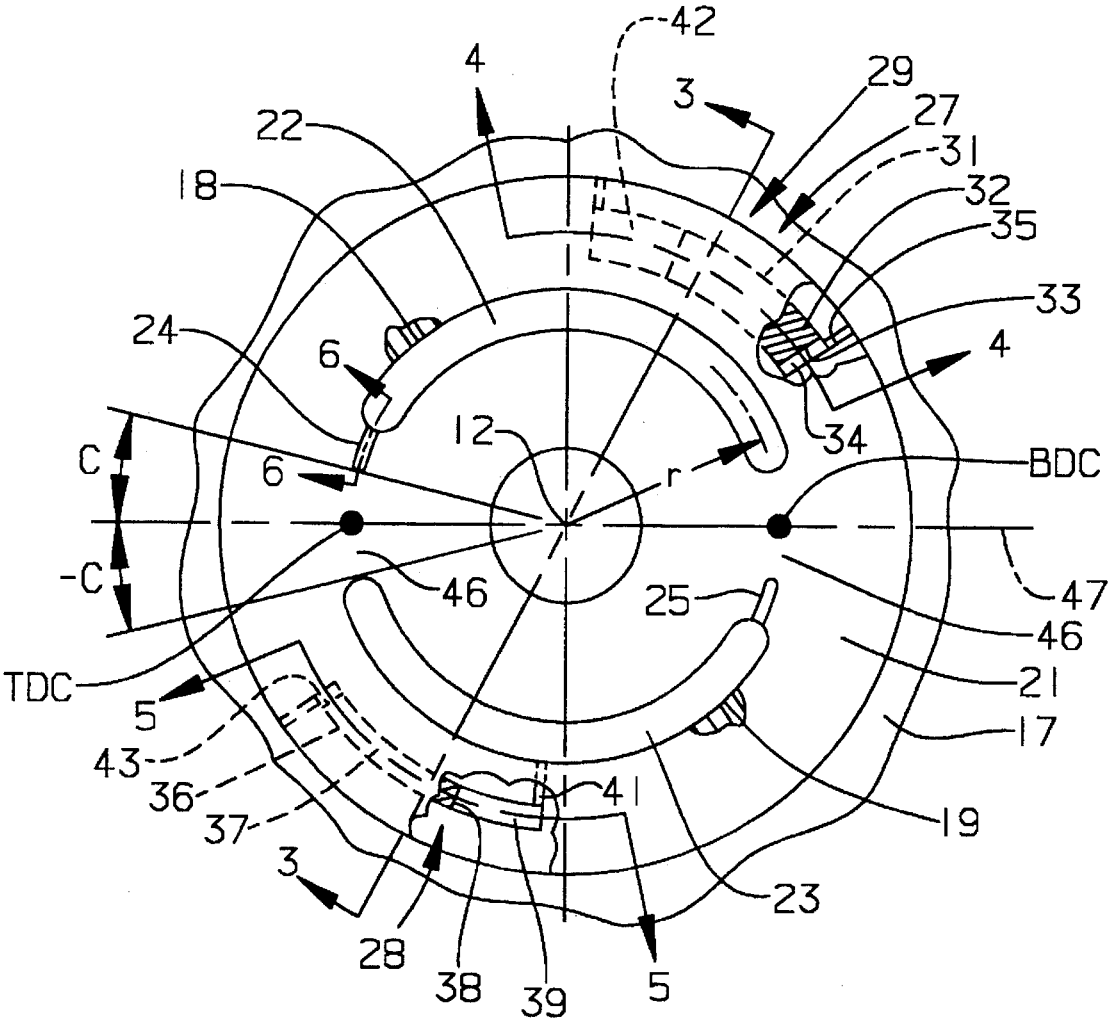
FIG. 2 is a plan view taken generally along line 2—2 of FIG. 1.
Figure 3:
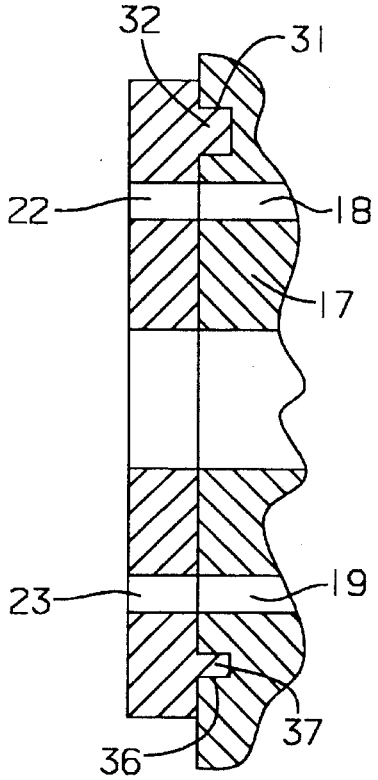
FIG. 3 is a sectional view taken along line 3—3 of FIG. 2.
Figure 4:
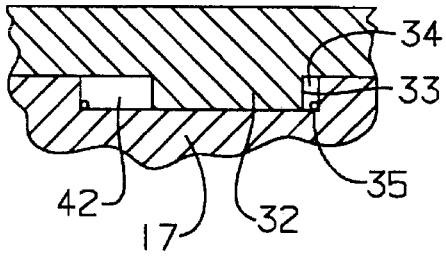
FIG. 4 is a sectional view taken generally along the line 4—4 of FIG. 2.
Figure 5:
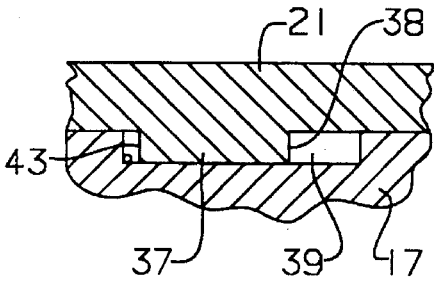
FIG. 5 is a sectional view taken generally along the line 5—5 of FIG. 2.
Figure 6:
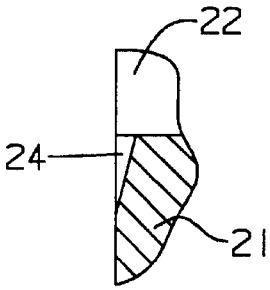
FIG. 6 is a sectional view taken generally along the line 6—6 of FIG. 2.

In use with the cylinder barrel 11 rotating clockwise relative to the port plate 21 as viewed in FIGS. 1 and 2, each piston bore 13 sequentially communicates with the intake port 18, sweeps through the transition region 47 at BDC, communicates with the discharge port 23, and sweeps through the transition region 46 at TDC to again communicate with the intake passage during each revolution of the cylinder barrel. Some of the pressurized fluid from the discharge ports becomes trapped in the piston bores and is carried over through the transition region 46. Similarly, some of the fluid from the intake port 22 becomes trapped in the piston bores and is carried over through the transition region 47. The accumulated effect of the forces generated by the individual pistons during each revolution results in swivel torque acting on the swashplate 15. Since a large portion of the swivel torque is due to the pressure carryover, the present invention utilizes the swivel torque to control the swashplate angle S.

Specifically, with no control pressure in the actuator chamber 32, the discharge pressure in biasing chamber 39 exerts a biasing force urging the port plate clockwise relative to the line 47 to the position shown in FIG. 2. With the port plate at this position, discharge pressure is carried over past TDC such that the swivel torque acts in a direction urging the swashplate 15 in a direction to reduce the angle S or toward the minimum displacement position. The letter C in FIG. 2 represents the carryover angle and, in this embodiment, the angle C is chosen so that sufficient swivel torque is developed to move the swashplate 15 to the minimum displacement position.

Increasing the control pressure in the actuating chamber 34 rotates the port plate 21 counterclockwise about the axis 12 of pump rotation relative to the line 47 thereby reducing the carryover angle C. This reduces the amount of discharge pressure carried over past TDC, thereby reducing the swivel torque urging the swashplate toward the minimum displacement position so that the combination of swivel torque and spring force tilts the swashplate 15 toward the maximum displacement position. The swashplate angle S is controlled by the pressure level in the actuator port 34. Eventually, the carryover angle C becomes zero and thereafter would become a negative number in the equation hereinafter set forth. Once the carryover angle becomes negative, the piston bores 13 start to communicate with the discharge port 23 prior to the piston bores reaching BDC and at some position, the swivel torque will start urging the swashplate toward the maximum displacement position.

The angle S of the swashplate can be calculated by the following formula:

$$S = \frac{X_o kL - \frac{N}{\pi} A_P r(P_d - P_i)(0.475)C}{kL^2 - \frac{N}{2} M_P r^2 R^2}$$

wherein:

$A_p$=piston area k=spring constant

L=spring force moment arm $M_p$=piston mass

N=number of pistons $P_d$=discharge pressure $P_i$=intake pressure r=piston pitch radius $x_o$=minimum compressed spring length S=swashplate angle C=pressure carry-over angle R=rotational pump speed In view of the foregoing, it is readily apparent that by designing the port plate capable of continuously varying the carryover angle C, the swashplate angle S can be controlled without the use of actuators. By eliminating the actuators, the overall size of the pump is reduced, the pump responds more quickly to a signal input, the volumetric efficiency is increased, and the cost of the overall pump package is reduced. Another advantage of the subject displacement control is that the amount of energy wasted for controlling the swashplate is minimized. More specifically, the subject displacement control utilizes the existing swivel torque to control the position of the swashplate rather than overcoming the swivel torque by exerting additional forces through an actuator.

Other aspect, objects and advantages of this invention can be obtained from a study of the drawings, the disclosure and the appended claims.

I claim:

1. A displacement control for a variable displacement axial piston unit comprising:

a head having an intake passage and a discharge passage therein;

a flat port plate coupled to the head for limited rotational movement relative thereto and having an arcuate intake port and an arcuate discharge port extending therethrough and continuously communicating with the intake and discharge passages respectively;

a rotatable cylinder barrel disposed in sliding contact with the port plate and having a plurality of equally spaced, circumferentially arranged piston bores therein disposed to sequentially open into the intake and discharge ports in a timed relation as the cylinder barrel rotates; and means for selectably rotating the port plate so that the timed opening of the piston bores into the intake and discharge ports is controllably changed, the means for selectably rotating including biasing means for exerting a biasing force against the port plate in a first rotational direction and a hydraulic actuator for selectably applying a variable control force against the port plate in opposition to the biasing force wherein the hydraulic actuator includes an arcuate pocket in either the head or the port plate and an arcuate piston extending from the other of the head or port plate and being slidably disposed within the arcuate pocket, the piston having an end defining an actuator chamber at one end of the arcuate pocket.

2. The displacement control of claim 1, wherein the biasing means includes a second arcuate pocket in either the head or the port plate, a second arcuate piston extending from the other of the head or the port plate and slidably disposed in the second pocket, the second piston having an end defining a biasing chamber, and a passage communicating the biasing chamber with the discharge passage.

3. The displacement control of claim 2, wherein the first and second arcuate pockets are formed in the head and the first and second arcuate pistons extend from the port plate.

4. The displacement control of claim 3, wherein the area of the end of the first piston is greater than the area of the end of the second piston.

5. The displacement control of claim 4, wherein the first and second arcuate pockets and the first and second arcuate pistons are concentric.

* * * * *